US007989765B2

(12) United States Patent
Hansen

(10) Patent No.: US 7,989,765 B2
(45) Date of Patent: Aug. 2, 2011

(54) METHOD AND APPARATUS FOR TRAPPING IONS

(75) Inventor: Stuart Carl Hansen, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 852 days.

(21) Appl. No.: 11/948,261

(22) Filed: Nov. 30, 2007

(65) Prior Publication Data

US 2009/0140141 A1 Jun. 4, 2009

(51) Int. Cl.
*H01J 49/42* (2006.01)

(52) U.S. Cl. ..... 250/292; 250/281

(58) Field of Classification Search ..... 250/292, 250/288, 282, 281, 294
See application file for complete search history.

(56) References Cited

U.S. PATENT DOCUMENTS 4,755,670 A * 7/1988 Syka et al. ..... 250/292
6,121,607 A * 9/2000 Whitehouse et al. ..... 250/288
6,872,938 B2 * 3/2005 Makarov et al. ..... 250/281
6,888,133 B2 * 5/2005 Wells et al. ..... 250/292
7,129,478 B2 * 10/2006 Baba et al. ..... 250/281
7,227,130 B2 6/2007 Hager et al.
2001/0050335 A1 * 12/2001 Whitehouse et al. ..... 250/288
2003/0141449 A1 * 7/2003 Wells et al. ..... 250/292
2005/0258354 A1 * 11/2005 Baba et al. ..... 250/281
2007/0023648 A1 * 2/2007 Baba et al. ..... 250/294
2009/0032700 A1 * 2/2009 Park et al. ..... 250/282

* cited by examiner

*Primary Examiner* — Robert Kim
*Assistant Examiner* — Johnnie L Smith
(74) *Attorney, Agent, or Firm* — Ballard Spahr LLP

(57) ABSTRACT

An ion trap comprising elongate rods, electrodes, a first circuit, and a second circuit. The rods are for defining the radial extent of a trapping volume. The first circuit is connected to the rods for applying thereto a first RF signal that generates adjacent the trapping volume a radial RF containment field that radially contains ions of different polarities within the trapping volume. The electrodes define the axial extent of the trapping volume. The second circuit is connected to the electrodes for applying thereto a second RF signal that generates adjacent the trapping volume an axial RF containment field that axially contains the ions of different polarities within the trapping volume. The axial RF containment field is independent of the radial RF containment field.

20 Claims, 6 Drawing Sheets

METHOD AND APPARATUS FOR TRAPPING IONS

BACKGROUND

Quadrupole ion traps are used in mass spectrometers to trap ions, i.e., atoms or molecules having a charge due to the loss or gain of one or more electrons. Quadrupole ion traps use electromagnetic fields generated by applying RF signals between elongate rods (or poles) to trap ions radially within a defined volume of space that will be referred in this disclosure to as a trapping volume. Quadrupole ion traps additionally use end caps axially offset from one another to trap the ions axially within the trapping volume.

Ion traps can be used for many different purposes in mass spectrometry and other fields. For instance, they can be used to store ions temporarily while the ions are waiting to be transferred to another part of a scientific instrument, such as a measurement stage. Likewise, they can be used to temporarily store of ions after the ions are created or after the ions exit a measurement stage of a scientific instrument.

Quadrupole ion traps also are often used for separating certain ions from other ions based on the mass to charge ratio (m/z) of the ions. Specifically, the electromagnetic fields that trap ions in the ion trap can be manipulated so that ions having an m/z ratio above or below a certain m/z ratio are ejected from the trap, while other ions having different m/z ratios remain in the trap.

It also is known to use an ion trap as a fragmentation cell in which ions are fragmented into smaller pieces. In an example, an inert gas such as argon is introduced into the trapping volume. The ions trapped in the trapping volume collide with the molecules of the inert gas with sufficient force to fragment the ions. The fragments and remaining intact ions are then ejected from the trap (either selectively based on m/z ratio or in their entirety) for further processing. For instance, the fragments and ions may be ejected toward a detector for measurement. Alternatively, in a tandem mass analyzer, the fragments and ions may be ejected into another mass analyzer stage, e.g., a Fourier transform mass analyzer, RF quadrupole mass analyzer, time of flight mass analyzer, or another quadrupole ion trap mass analyzer.

As mentioned above, quadrupole ion traps use electromagnetic fields to contain the ions within the trapping volume both radially and axially. Ions can be admitted or ejected from the ion trap by altering the electric fields (e.g., turning one or more of the electric fields off or changing the amplitude and/or frequency of one or more of the electric fields) so that the ions, or at least ions having certain m/z ratios, enter or exit the trapping volume. In most quadrupole ion traps, ions enter the trapping volume travelling axially through one of the ends of the trapping volume. Many quadrupole ion traps also permit ions to exit the trap travelling axially through one of the ends of the trapping volume, typically, the end axially opposite from the entrance end. However, the ions may enter and exit the trapping volume through the same end. Other ion traps eject ions radially. Specifically, a gap may be provided in one or more of the elongate poles through which ions can exit travelling radially.

Generally, the ions are contained radially within the trapping volume by an RF containment field generated by applying an RF signal to the poles. Typically, the RF signal is a differential signal, and the in-phase component of the RF signal is applied to two opposing poles of the quadrupole and the antiphase component of the RF signal is applied to the other two opposing poles of the quadrupole.

With respect to axial containment, a quadrupole ion trap that traps ions of only a single polarity at any given instant typically axially contains the ions by applying a DC voltage to each of the axial end caps. This potential causes the ions to travel back and forth in the axial direction within the trapping volume.

However, a DC field cannot trap both positive and negative ions simultaneously because a particular axial DC field will provide an effective barrier for ions of one polarity, but would accelerate the ions of the opposite polarity axially out of the trapping volume.

U.S. Pat. No. 7,227,130 discloses a technique for generating axial RF fields that can simultaneously contain ions of both positive and negative polarities both axially and radially. Specifically, this patent discloses the application of particular RF signals between the quadrupole rods to generate a radial RF containment field in conjunction with the application of other RF signals between the end caps and the rods to generate an axial RF containment field between the end caps and the rods of the quadrupole. The axial RF containment field keeps ions of both polarities trapped and circulating between the two end caps.

One drawback of the technique described in the U.S. Pat. No. 7,227,130 is that the axial containment field and radial containment field are interdependent, i.e., they interact with each other. Consequently, one cannot be changed without affecting the other. Thus, for instance, changing the radial containment field to reduce the trapping volume radially would also change the axial containment field. To restore the axial containment field to its original state would require that the RF signals applied to the end caps be adjusted accordingly.

DETAILED DESCRIPTION

An ion trap comprises elongate rods, electrodes, a first circuit, and a second circuit. The rods are for defining the radial extent of a trapping volume. The first circuit is connected to the rods for applying thereto a first RF signal that generates adjacent the trapping volume a radial RF containment field that radially contains ions of different polarities within the trapping volume. The electrodes are for defining the axial extent of the trapping volume. The second circuit is connected to the electrodes for applying thereto a second RF signal that generates adjacent the trapping volume an axial RF containment field that axially contains the ions of different polarities within the trapping volume. The axial RF containment field is independent of the radial RF containment field.

Figure 1:
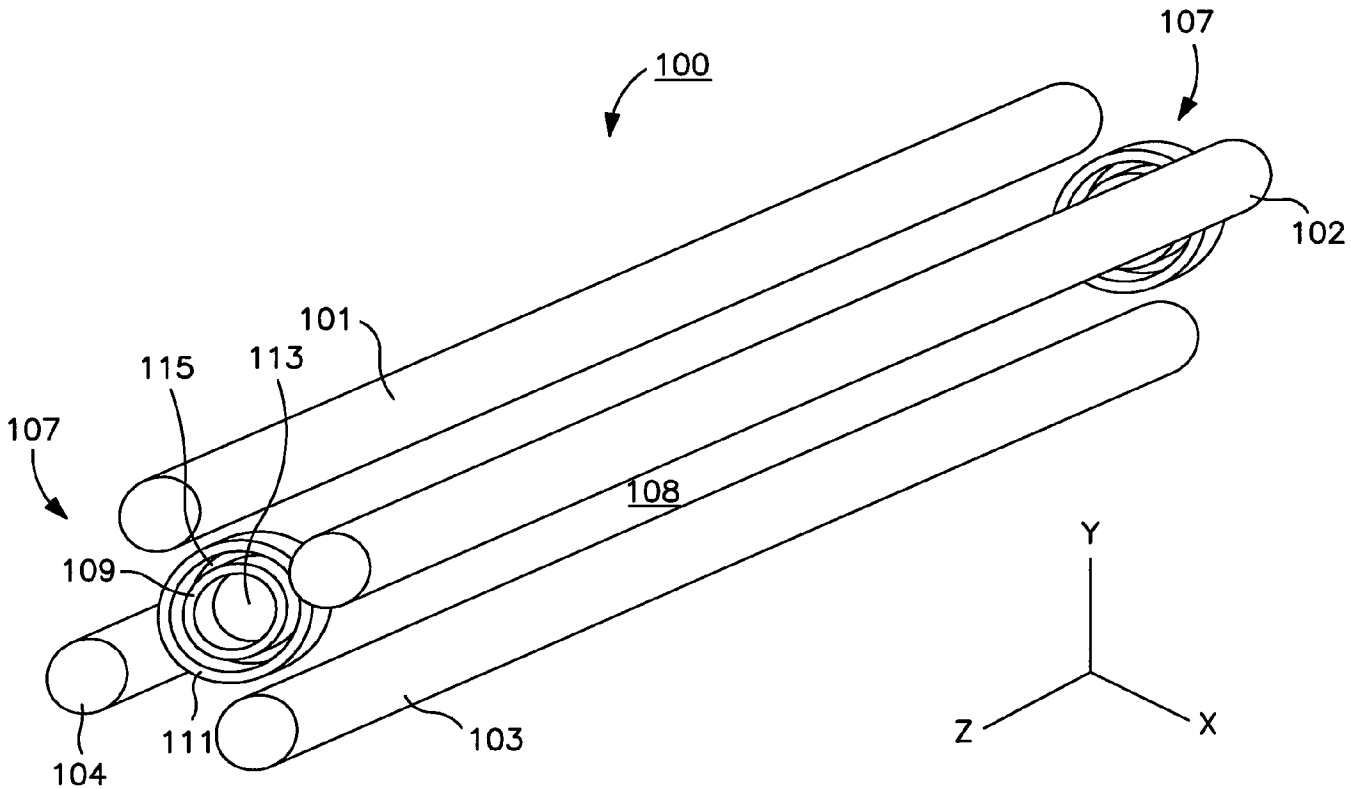
FIG. 1 is a perspective view of a quadrupole ion trap in accordance with one embodiment of the invention.
Figure 2A:
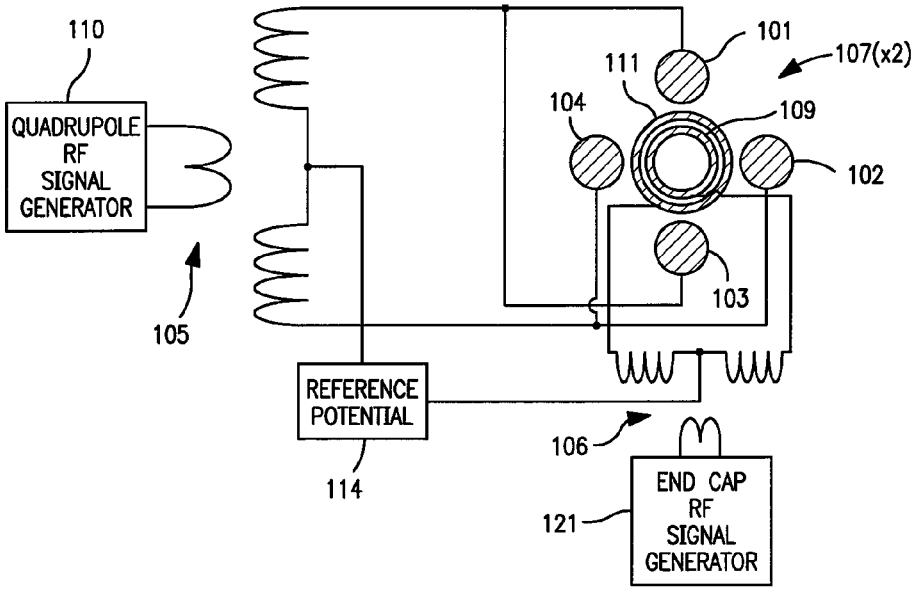
FIG. 2A is a schematic representation of the quadrupole ion trap of FIG. 1 showing related circuitry for an embodiment that is driven with a differential signal.
Figure 2B:
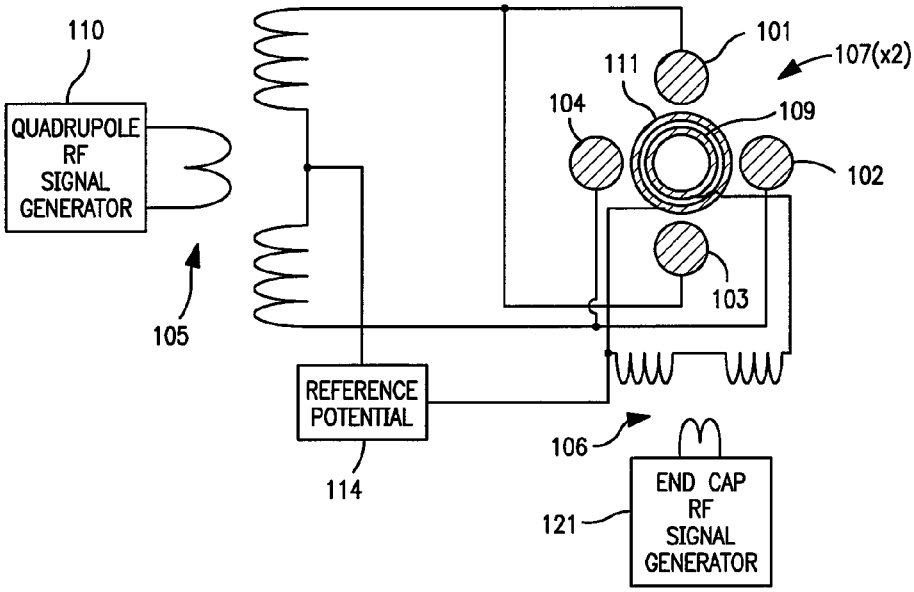
FIG. 2B is a schematic representation of the quadrupole ion trap of FIG. 1 showing related circuitry for an embodiment that is driven with a single-ended signal.

FIG. 1 is a perspective view of a quadrupole ion trap 100 in accordance with an embodiment of the invention. The figures in this specification are not necessarily drawn to scale but have been drawn to facilitate the viewing of the various features. FIG. 2A is a schematic diagram of the same ion trap further illustrating related circuitry for an exemplary embodiment utilizing a differential RF drive signal. FIG. 2B is a schematic diagram illustrating a similar embodiment to that of FIG. 2A, but utilizing a single-ended RF drive signal.

The use of a quadrupole configuration for radially confining ions is merely exemplary and it should be understood that the invention can be applied to multi-pole ion traps having other numbers of poles.

The illustrated quadrupole embodiment comprises four elongate rods 101, 102, 103, and 104 that provide the poles of the ion trap. A radio frequency (RF) electrical signal is applied between the rods to generate a radial containment field for confining the ions in the radial direction, i.e., in the direction of the x-y plane shown in FIG. 1. Particularly, with reference to FIG. 2A, an RF signal generator 110 is connected to the rods 101-104. In the example shown, the RF signal generator 110 incorporates a center-tapped transformer 105 to generate the RF signal as a differential RF signal. The center tap of transformer 105 is connected to a reference potential 114 such as a DC source (including ground) or a low frequency RF (Radio Frequency) source. One phase of the RF signal is connected to one pair of opposing rods 101 and 103 and the other phase of the RF signal is connected to the other pair of opposing rods 102 and 104. Alternatively, RF signal generator 110 can generate a differential RF signal without the use of a transformer. In yet other alternative embodiments, the RF signal is a single-ended RF signal. The RF signal is applied between the rods 101-104 to define the radial extent of a trapping volume 108. The generation of radial containment fields in quadrupole mass spectrometers is known in the art and, hence, will not be discussed in further detail.

Adjacent each end of the rods 101-104 is located an end cap 107 having two electrodes 109 and 111 between which an RF signal is applied to generate an axial containment field as described below. In the illustrated embodiment, the end caps 107 are within the axial ends of the volume defined by the rods 101-104. However, this is not a requirement. In the example shown in FIG. 1, the electrodes 109, 111 are annular and concentric. The electrode 109 is an inner annular electrode and the electrode 111 is an outer annular electrode. Inner annular electrode 109 defines an axial aperture 113 that extends through it in the z-direction shown in FIG. 1. Ions traveling in the axial direction may enter and/or exit the trapping volume 108 through the aperture 113.

Outer annular electrode 111 defines a second axial aperture 115 that extends through it in the z-direction and within which the inner annular electrode 109 is positioned. The inner and outer annular electrodes 109 and 111 typically are positioned at the same location in the z-direction.

A second RF signal generator 121, typically similar in structure to above-described RF signal generator 110, applies an RF signal between the electrodes 109, 111 through a second center-tapped transformer 106. The second transformer 106 also may be connected to reference potential 114, as illustrated in FIG. 2A. The RF signal generator 121 generates an RF signal of suitable frequency (typically in the range of about 5 kHz to about 5 MHz) and amplitude sufficient to cause the resulting axial RF containment field to contain ions of both positive and negative polarity and within a particular range of m/z ratios within the trapping volume 108 in the axial direction. Particularly, the axial containment field generated by applying the RF signal to the electrodes 109, 111 will keep the ions circulating back and forth in the z-direction within the trapping volume 108 while the elongate rods 101-104 contain the ions within the trapping volume 108 in the radial direction. The amplitude of the RF signal applied to the electrodes 109, 111 will depend largely on the physical dimensions of the electrodes 109, 111 and other case-specific factors.

In the examples shown in FIGS. 2A and 2B, rods 101-104 are shown directly connected to RF signal generator 110 and electrodes 109, 111 are shown directly connected to RF signal generator 121. In other examples, circuit elements such as coupling capacitors, filters, etc. are interposed between rods 101-104 and RF signal generator 110 and/or between electrodes 109,111 and RF signal generator 121. In such examples, rods 101-104 will be regarded as being connected to RF signal generator 110 and electrodes 109, 111 will be regarded as being connected to RF signal generator 121 notwithstanding the intervening circuit elements.

Merely as an example of a typical set of dimensions for an ion trap in accordance with the invention, the quadrupole rods are about 10 mm in diameter. Opposite ones of the rods, e.g., rods 101 and 103, are spaced from each other about 19 mm center-to-center, i.e., the rods collectively define within the trapping volume 108 a cylindrical space about 9 mm in diameter. The electrodes 109, 111 constituting each end cap 107 are a thin-walled metal sleeve about 0.5 mm thick. The inner electrode 109 has an inner diameter of 5 mm and an outer diameter of 6 mm and the outer electrode 111 has an inner diameter of 7 mm and an outer diameter of 8 mm. This particular embodiment provides a radial clearance of about 1 mm between the two annular electrodes 109, 111 and about 1 mm of radial clearance between the outer electrode 111 and the rods 101-104 of the quadrupole. An exemplary amplitude and frequency of the axial containment field for an for a particular ion trap having the dimensions noted above is about 400 volts peak-to-peak at a frequency of 1 MHz.

Applying the RF signal between the electrodes 109, 111 makes the resulting axial containment field largely or entirely independent of the radial containment field. Specifically, the terminals of the axial containment field, i.e., the electrodes 109, 111 are physically and electrically independent of the terminals of the radial containment field, i.e., rods 101-104. Accordingly, there is little or no interaction between the axial and radial containment fields. This is a significant advantage since the radial containment field and the axial containment field can be controlled independently of each other without significant interdependence.

A differential RF signal can be applied between the two electrodes 109, 111, as illustrated in FIG. 2A. However, the RF signal alternatively may be single-ended, as illustrated in FIG. 2B. In such a case, the RF signal may be applied between the electrodes, as in the differential embodiment of FIG. 2A, but one of the electrodes, e.g., outer electrode 111, may be connected to a reference potential having a low impedance at the frequency of the RF signal, e.g., ground, such as the reference potential 114 as shown in FIG. 2B. In the single-ended configuration, connecting the outer electrode 111 to the reference potential provides good isolation of the axial containment field from the radial containment field.

The end cap electrodes 109, 111 constituting each end cap 107 may be positioned beyond the ends of the quadrupole rods 101-104, if desired. However, care should be taken that they are close enough to the ends of the rods 101-104 that there is no gap between the axial containment field and the radial containment field through which ions might be able to escape. Furthermore, placing the end cap electrodes within the axial extent of the quadrupole rods, as illustrated in FIG.

1, simplifies the fringe fields between the rods and the end caps and makes the fringe fields less problematic.

Particularly good isolation between the axial containment field and the radial containment field is achieved when the inner electrode 109 and the outer electrode 111 are substantially coplanar in the x-y plane and the outer electrode 111 is at least as long as the inner electrode 109 so that the outer electrode 111 completely occludes the inner electrode in the radial direction. The length of the electrodes is the dimension of the electrodes in the z-direction. Furthermore, particularly good containment is achieved while preserving the good isolation between the axial containment field and the radial containment field when the outer annular electrode 111 extends inwardly in the z-direction farther than the inner electrode 109. 109. For example, in one exemplary embodiment, the outer electrode 111 is longer than the inner electrode 109. Thus, if the axially outer end of the inner electrode 109 and the axially outer end of the outer electrode 111, i.e., the ends facing away from the trapping volume 108, are made even with each other (i.e., coplanar in the x-y plane), then the outer electrode 111 will extend inwardly in the z-direction farther than the inner electrode 109. This configuration slightly tilts the axial containment field toward the central longitudinal axis of the trapping volume, i.e., the axis that extends in the z-direction and is centered on the intersection of the line in the x-y plane extending between the centers of rods 101 and 103 and the line in the x-y plane extending between the centers of rods 102 and 104. This configuration actually provides better containment of ions traveling along the z-axis. It has been found that an outer electrode 111 that is longer than the inner electrode by about one half of the inner diameter of the inner electrode 109 provides particularly good isolation between the axial containment field and the radial containment field as well as good axial ion containment. In an example of this type of configuration, the inner electrode has an inner diameter of about 5 mm, the inner electrode is about 5 mm long, and the outer electrode is about 7.5 mm long.

It should be understood that, while the annular shape of the electrodes 109, 111 is particularly suitable because annular electrodes generate a containment field closely corresponding to the cross-sectional shape of the radial containment field (in the x-y plane), thereby providing a particularly uniform containment field where it is needed, this electrode shape is merely exemplary. In alternative embodiments, electrodes 109, 111 are square, rectangular, hexagonal, or irregular in shape in the x-y plane shown in FIG. 1. The electrodes 109, 111 need not even have the same shape as each other. However, in embodiments of the concentric ring type electrodes described in connection with FIGS. 1 and 2, the outer electrode should define an axial aperture capable of accommodating the inner electrode.

An end cap in accordance with the present invention may be applied at either or both ends of a multipole ion trap.

Ions are axially ejected from the trapping volume 108 through the aperture 113 in the inner end cap electrode 109 when the axial containment field is turned off (or decreased in amplitude). However, if the particular instrument does not require axial ejection (or entry) of ions through a particular end cap, then the inner electrode of that end cap need not have an aperture.

Figure 3:
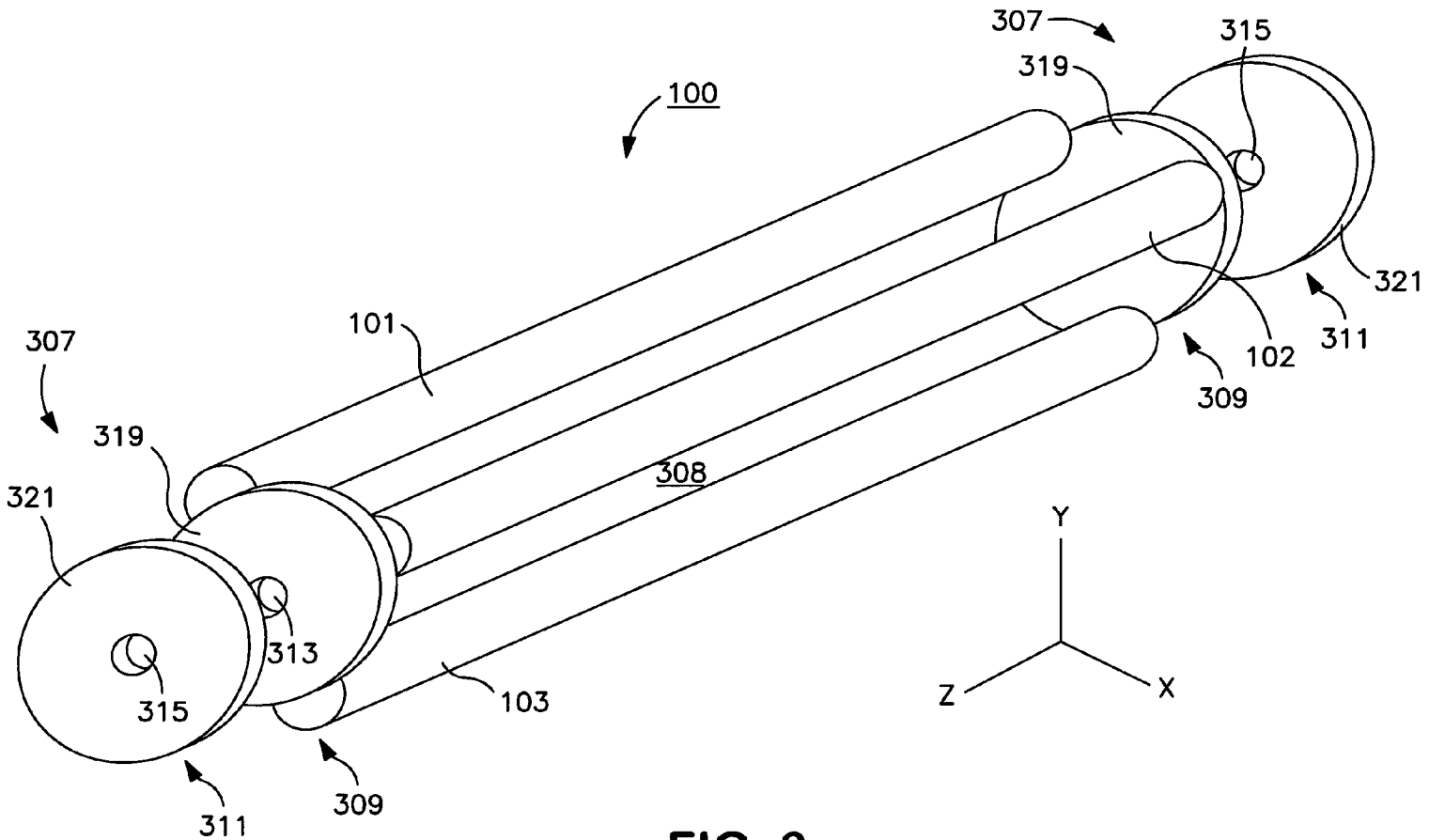
FIG. 3 is a perspective view of a quadrupole ion trap in accordance with another embodiment of the invention.

FIG. 3 illustrates an alternative embodiment of a quadrupole ion trap in accordance with the invention. In this embodiment, adjacent each end of the rods 101-104 are located an end cap 307 composed of two planar electrodes 309 and 311 axially spaced from each other in the z-direction. In the illustrated embodiment, the electrodes 309, 311 are positioned outside of the axial extent of the quadrupole rods. This is not a necessity. Alternatively the electrodes 309, 311 may be positioned axially inside of the ends of the rods 101-104. However, positioning the end cap electrodes 309, 311 within the axial extent of the rods results in more complex fringe fields between the end caps 307 and the rods 101-104, which may be undesirable. Electrodes 309, 311 are each composed of a respective conductive plate 319, 321 defining an axial aperture 313, 315 that extends through the conductive plate in the z-direction. This arrangement of elements is commonly used in other applications for focusing and directing ions as a part of what is commonly referred to as an Einzel lens.

As in the embodiment shown in FIGS. 1 and 2, an RF signal for generating the axial containment field is applied between the electrodes 309, 311. As before, the RF signal can be a differential signal or a single-ended signal. In a single-ended implementation, one of the electrodes is connected to a reference potential having a low impedance at the frequency of the RF signal and the other of the electrodes is connected to receive the RF signal. In such an embodiment, the electrode 309 closer to the trapping volume 308 is connected to the reference potential and the electrode 311 further from the trapping volume is connected to the RF signal. This arrangement provides superior isolation between the radial containment field and the axial containment field.

The embodiment shown in FIG. 3 has essentially the same advantages as the embodiment shown in FIGS. 1 and 2. Particularly, the terminals of the axial containment field are independent of the terminals of the radial containment field, with the same attendant benefits.

In one exemplary embodiment, the plates 319, 321 are each 0.5 mm thick, the apertures 313, 315 are 3 mm in diameter and the two electrodes 309, 311 are axially spaced from each other about 1 mm. The plates 319, 321 may be circular in shape to closely correspond to the radial shape of the trapping volume. However, other shapes are possible, including square, rectangular, polygonal, and irregular shapes. The two electrodes need not have the same shape, although using electrodes of different shapes will make the axial containment field more complex. In a particularly effective embodiment, the plates 319, 321 extend in the x-y plane beyond the cylindrical space collectively defined by the quadrupole rods. Thus, if the cylindrical space defined by the rods 101-104 is about 9 mm in diameter as mentioned above in connection with the embodiment of FIGS. 1 and 2, then the plates 319, 321 have a diameter of greater than 9 mm in this embodiment. In one example, the quadrupole rods are 10 mm in diameter and define a space 9 mm in diameter, the plates 319, 321 have a diameter of between 20-29 mm, and the apertures 313, 315 have a diameter of about 3 mm.

As in the embodiment of FIGS. 1 and 2, if ions need not pass through an end cap, then one or both of the electrodes of that end cap need not include a respective aperture.

In the example shown, the conductive plates 319, 321 are disposed parallel to each other and orthogonal to the z-axis, and the apertures 313, 315 are centered on the z-axis. This permits ions to pass through the end cap in a straight line when the axial containment field is turned down or off to eject ions from the trap. If it is desired to cause the ions to travel off axis or otherwise take a more tortuous course as they exit the trapping volume, which usually is not desirable, but actually may be useful in some applications, then the apertures may be provided in a non-aligned configuration. In such embodiments the ions may be induced to take such course by making the shapes of the plates 319, 321 different from each other to adjust a differential DC field to a value that induces the desired trajectory through the non-aligned apertures in the plates.

Figure 4:
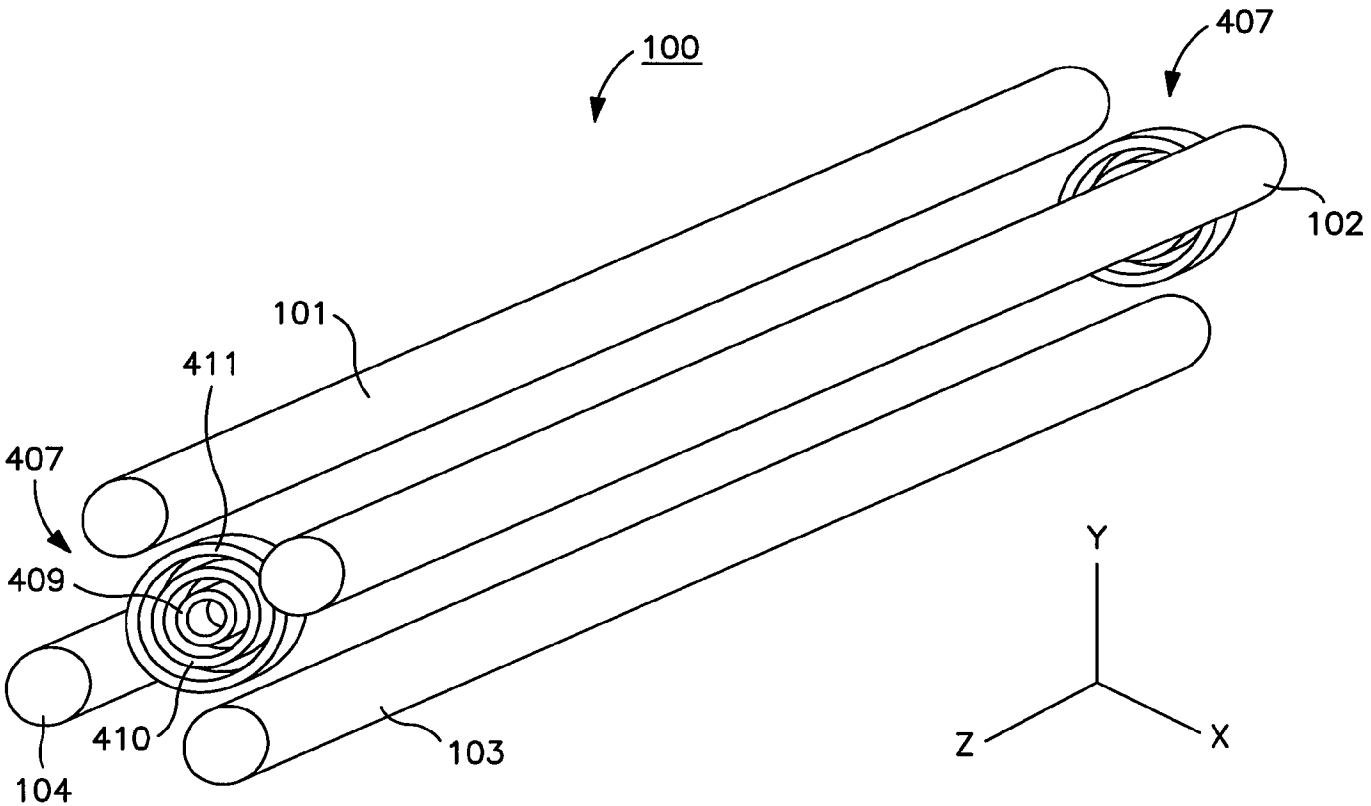
FIG. 4 is a perspective view of a quadrupole ion trap in accordance with another embodiment of the invention.

FIG. 4 illustrates another exemplary embodiment of a quadrupole ion trap in accordance with the invention. The embodiment shown in FIG. 4 is similar to the embodiment described above with reference to FIGS. 1 and 2, but employs end caps 407, each composed of three nested electrodes 409, 410, and 411. In the example shown, the electrodes 409, 410 and 411 are annular and concentric. The electrodes 409, 410, 411 have similar possibilities of alternative shapes and arrangements to those described above with reference to the electrodes 109, 111 shown in FIG. 1. In one single-ended implementation of this embodiment, the inner electrode 409 and the outer electrode 411 are connected to the reference potential 114, and the middle electrode 410 is connected to receive the RF signal. While not a requirement, it is believed that this configuration will provide the most effective isolation between the axial containment field and the radial containment field since the axial containment field is shielded on both radial sides by the reference potential.

In differentially driven implementations of this embodiment, there are many possible ways of supplying the differential drive voltage to the electrodes 409-411. In one embodiment, the inner electrode 409 and the middle electrode 410 are each supplied with a respective phase of the differential RF voltage, while the outer electrode 411 is connected to the reference potential. This configuration is believed to provide the most effective isolation between the axial containment field and the radial containment field.

Figure 5:
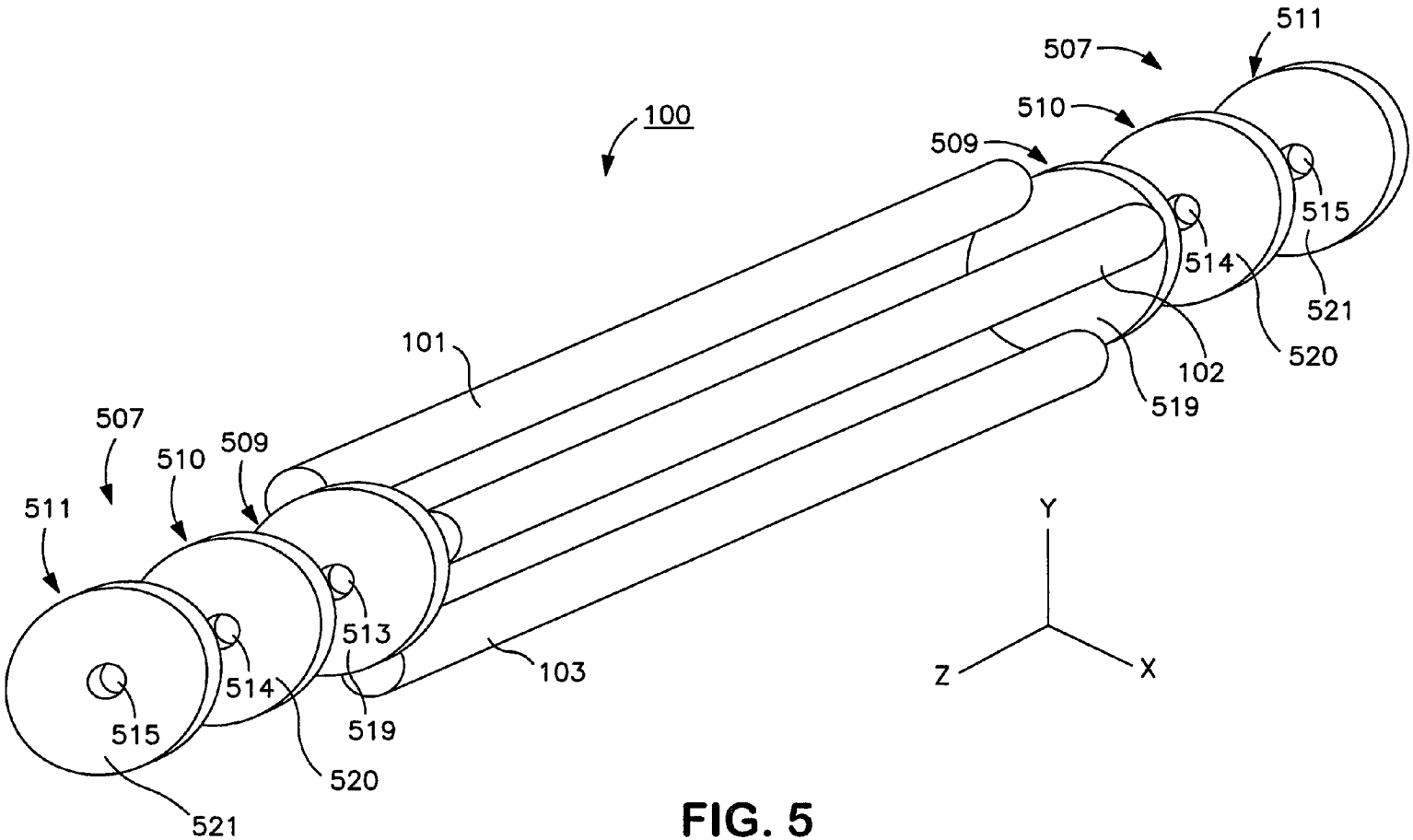
FIG. 5 is a perspective view of a quadrupole ion trap in accordance with another embodiment of the invention.

FIG. 5 illustrates another exemplary embodiment of a quadrupole ion trap in accordance with the invention. In this embodiment, adjacent each end of rods 101-104 are located end caps 507 each composed of three axially-spaced planar electrodes 509, 510, 511 arrayed in the z-direction. Electrodes 509, 510, 511 are each composed of a respective conductive plate 519, 520, 521 defining an axial aperture 513, 514, 515 that extends through the conductive plate in the z-direction. In the example shown, the conductive plates 519, 520, 521 are disposed parallel to each other and orthogonal to the z-axis, and are spaced about 1 mm from each other in the z-direction. The apertures 513, 514, 515 are centered on the z-axis. As before, if the apertures are not so aligned, then the ions would have to travel off-axis to exit from the trapping volume through the end cap, which could conceivably be desirable in certain applications. The apertures are circular, but this is not a requirement. The apertures need not be of any particular size and the apertures in all three plates need not even be the same size or shape. Also, if, for some reason, ions do not need to enter or exit the trapping volume through a particular end cap, then the aperture may be omitted from one or more of the plates constituting that end cap.

Again, there are numerous ways to supply the RF signal for generating the axial containment field to the electrodes 509, 510, 511. In at least one single-ended embodiment, the middle electrode 510 is connected to receive the RF signal while the axially inner electrode 509 and the axially outer electrode 511 are connected to the reference potential. This is believed to provide the greatest isolation between the radial containment field and the axial containment field since the RF field is shielded on both axial sides by the electrodes 509, 511. However, this connection scheme is not a requirement.

In a differentially driven version of this type of embodiment, the axially inner electrode 509 is connected to the reference potential and the two outer electrodes 510, 511 are connected to respective phases of the differential RF signal to provide the greatest isolation between the axial containment field and the radial containment field. Other differential connection schemes may be used.

As noted above, the quadrupole configuration for providing the radial containment field in all of the illustrated embodiments is merely exemplary and the axial containment concepts disclosed herein can be applied to multipole ion traps with other numbers of rods for providing the radial containment field. The concepts can be used in connection with hexapole, octopole, dodecapole, and other radial containment field configurations. Moreover, the axial containment field can be provided using more annular electrodes or more planar electrodes than the numbers shown the above-described examples. However, each additional electrode in excess of three provides a diminishing benefit. Also, while the exemplary embodiments illustrate the use of the innovative concepts in connection with linear ion traps, this also is not a limitation.

Figure 6:
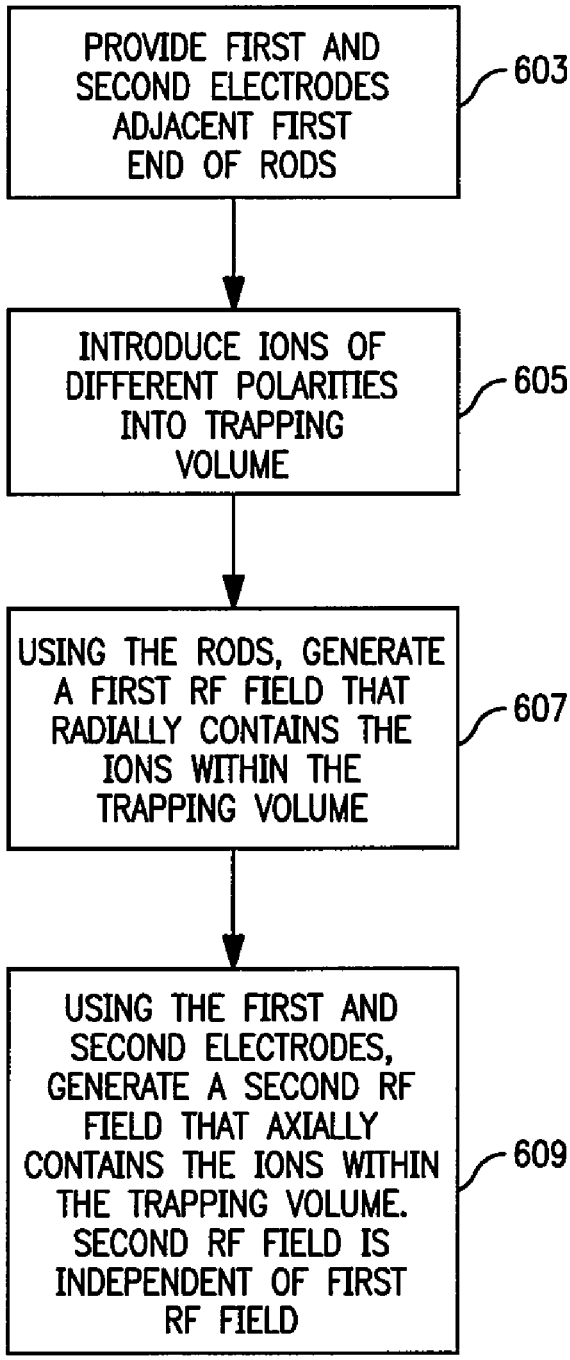
FIG. 6 is a flow diagram illustrating a process in accordance with an embodiment of the invention.

FIG. 6 illustrates an example of a process for trapping ions within a trapping volume in accordance with an embodiment of the invention. In block 601, elongate rods are provided. The rods have first and second ends and define the radial extent of the trapping volume. In block 603, first and second electrodes are provided adjacent the first ends of the rods. In block 605, ions of different polarities are introduced into the trapping volume. In block 607, the rods are used to generate a first RF field that radially contains the ions within the trapping volume. In block 609, the first and second electrodes are used to generate a second RF field that axially contains the ions within the trapping volume. The second RF field is independent of the first RF field.

This disclosure describes the invention in detail using illustrative embodiments. However, the invention defined by the appended claims is not limited to the precise embodiments described.

I claim:

1. An ion trap, comprising:

elongate rods for defining a radial extent of a trapping volume;

a first circuit connected to the rods for applying thereto a first RF signal that generates adjacent the trapping volume a radial RF containment field that radially contains ions of different polarities within the trapping volume;

electrodes for defining an axial extent of the trapping volume; and a second circuit connected to the electrodes for applying thereto a second RF signal that generates adjacent the trapping volume an axial RF containment field that axially contains the ions of different polarities within the trapping volume, the axial RF containment field independent of the radial RF containment field.

2. The ion trap of claim 1, wherein:

the electrodes comprise a first electrode and a second electrode;

the first electrode is annular and defines a first aperture and the second electrode is annular and defines a second aperture; and the first electrode is disposed in the second aperture.

3. The ion trap of claim 1, wherein:

the electrodes comprise a first planar electrode and a second planar electrode; and the first and second planar electrodes are axially offset relative to each other.

4. An ion trap, comprising:

elongate rods extending axially and defining a radial extent of a trapping volume for ion entrapment;

a first electrode positioned adjacent the rods, the electrode defining an aperture extending axially therethrough;

a second electrode positioned adjacent the first electrode;

a first circuit for supplying to the rods a first RF signal that generates a first electromagnetic field that radially contains ions within the trapping volume; and a second circuit for supplying between the first electrode and the second electrode a second RF signal that generates a second electromagnetic field that axially contains ions within the trapping volume.

5. The ion trap of claim 4, wherein:

the first electrode defines an aperture that extends axially therethrough;

the second electrode defines an aperture that extends axially therethrough; and the apertures in the first and second electrodes are coaxial.

6. The ion trap of claim 5, wherein the first electrode is located within the aperture of the second electrode.

7. The ion trap of claim 6, wherein the second electrode is connected to a reference potential and the second circuit applies the RF signal to the first electrode.

8. The ion trap of claim 6, wherein the first and second electrodes are annular.

9. The ion trap of claim 6, wherein the first and second electrodes are located entirely within the radial extent of the rods.

10. The ion trap of claim 9, wherein the elongate rods each have first and second axial ends and wherein the first and second electrodes are positioned within the axial ends of the rods in the axial direction.

11. The ion trap of claim 5, wherein the first and second electrodes are axially offset from each other.

12. The ion trap of claim 11, wherein the first and second electrodes each comprise conductive plates, each conductive plate defining an aperture extending axially therethrough.

13. The ion trap of claim 12, wherein:

the elongate rods each have first and second axial ends;

the first and second electrodes are positioned beyond the axial ends of the rods in the axial direction; and the first and second electrodes extend radially beyond the radial extent of the trapping volume.

14. The ion trap of claim 11, wherein:

the first electrode is closer to the rods than the second electrode; and the first electrode is connected to a reference potential and the second circuit applies the RF signal to the second electrode.

15. The ion trap of claim 4, wherein the second circuit is additionally for supplying a direct-current signal between the first and second electrodes.

16. The ion trap of claim 4, additionally comprising a third electrode positioned adjacent the first and second electrodes.

17. The ion trap of claim 16, wherein:

the second and third electrodes each define a respective aperture extending axially therethrough;

the first, second, and third electrodes are axially offset from each other with their respective apertures radially aligned;

the first electrode is positioned axially between the second and third electrodes; and the second circuit applies the RF signal to the second electrode and the first and third electrodes are connected to a reference potential.

18. The ion trap of claim 16, wherein:

the second and third electrodes each define a respective aperture extending axially therethrough;

the first electrode is located within the aperture defined by the second electrode;

the second electrode is located within the aperture defined by the third electrode; and the first and third electrodes are connected to a reference potential and the second circuit applies the RF signal to the second electrode.

19. The ion trap of claim 4, wherein the rods number at least four.

20. A method of trapping ions within a trapping volume, the radial extent of the trapping volume being defined by elongate rods, the rods having a first end and a second end, the method comprising:

providing first and second electrodes adjacent the first ends of the rods;

introducing ions of different polarities into the trapping volume;

using the rods, generating a first RF field that radially contains the ions within the trapping volume; and using the first and second electrodes, generating a second RF field that axially contains the ions within the trapping volume, the second RF field independent of the first RF field.

* * * * *